US006467223B1

(12) United States Patent
Christley

(10) Patent No.: US 6,467,223 B1
(45) Date of Patent: Oct. 22, 2002

(54) COMPOSITE CONCRETE AND STEEL FLOOR/CARRIER FOR MODULAR BUILDINGS

(76) Inventor: Jack Christley, 1706 Creekway Dr., Lewisville, TX (US) 75067

( * ) Notice: Subject to any disclaimer, the term of this patent is extended or adjusted under 35 U.S.C. 154(b) by 0 days.

(21) Appl. No.: 09/490,899

(22) Filed: Jan. 25, 2000

Related U.S. Application Data

(60) Provisional application No. 60/117,432, filed on Jan. 27, 1999.

(51) Int. Cl.[7] ..... E04C 2/38
(52) U.S. Cl. ..... 52/143; 52/334; 52/414
(58) Field of Search ..... 52/143, 414, 319, 52/334, 602

(56) References Cited

U.S. PATENT DOCUMENTS 3,492,767 A * 2/1970 Pincus ..... 52/143
3,877,187 A * 4/1975 Livingston ..... 52/143
3,944,242 A * 3/1976 Eubank ..... 52/143
4,077,170 A * 3/1978 van der Lely ..... 52/602
4,320,607 A * 3/1982 Eubank ..... 52/143
4,545,159 A * 10/1985 Rizk ..... 52/143
4,882,883 A * 11/1989 Horn ..... 52/143
5,113,625 A * 5/1992 Davis ..... 52/143
5,640,814 A * 6/1997 Godfrey ..... 52/143
5,890,341 A * 4/1999 Bridges et al. ..... 52/143

* cited by examiner

*Primary Examiner*—Michael Safavi

(57) ABSTRACT

A very strong lightweight modular composite concrete and steel floor that can be attached to; a light steel carrier for transportation, a foundation for a single story structure, or a light steel ceiling frame for a multistory ceiling/floor assembly, that creates a compound structure that is substantially stronger than the sum of the strength of the individual components. The thin upper concrete plane acting as the compression flange is connected by shear connectors to a pair of web members which are connected to metal chords acting as the tension flanges to create a double "T". This in turn can be connected to a pair of web member/metal flange structures creating an even taller stronger double "T" for; the carrier, or the long spanning ceiling/floor assembly of a multistory building. The module is delivered to the site, unbolted from the carrier and set on the foundation or connected to the lower story module. The carriers can then be stacked and returned to the manufacturing facility for reuse.

2 Claims, 12 Drawing Sheets

COMPOSITE CONCRETE AND STEEL FLOOR/CARRIER FOR MODULAR BUILDINGS

This application claims benefit of Provisional Application No. 60/117,432, filed Jan. 27, 1999.

BACKGROUND—FIELD OF INVENTION

This invention relates to a single or multistory modular compound composite concrete and steel floor for modular buildings. The objective is not only to provide an economical, structurally efficient, higher quality and more durable modular building, but to be able to handle, transport and install it economically as well.

BACKGROUND—DESCRIPTION OF PRIOR ART

Theoretically, an item built in mass production in a controlled environment ought to be able to be produced at a lower cost and higher quality than the same item built on a custom basis out in the elements. This is experienced in the auto industry, the computer industry and many others. This has not, however, been experienced as successfully in the building construction industry. It is true that structural members, plumbing, mechanical, electrical and other building components have adopted mass production, but their complete assembly into a building has not. The bulkiness of buildings generally does not allow them in whole to be built in a factory or easily shipped and installed. As a result, buildings were divided into sections or modules, mass production was attempted to be applied and the modular building process was created. But even this industry has not achieved the economical and quality benefits the production process ought to provide. In most areas of the country commercial modular buildings are generally no less expensive than a building built on site. And the durability, quality and aesthetics of the modular product often does not match that of conventional. So if value is the measure of quality versus cost, unlike other industries, the modular production process has provided less value than conventional construction. As a result the modular industry has managed to capture only a relatively small part of the construction market. Namely, that part of the market that must be relocatable. If a commercial building can be built conventionally, modular generally has not been considered an option. Reasons for the inability of the industry to provide more value than conventional construction include: shipping restrictions, architectural paradigms and quality gaps, shipping and handling costs and, apparently, a lack of expertise to overcome these characteristics.

The most obvious characteristic of modular construction is that the modules must be transportable. This poses challenges in several ways. Transportability is mainly a function of road and bridge geometry and strength. As a result, modules have to fit within maximum rectangular volume and weight constraints regulated by the department of transportation or some other governmental agency. Roads in the US have relatively liberal widths but other factors such as telephone poles and signs on street corners make it difficult in some cases to maneuver wide or very long modules. But this is much less of a problem than the height limitations imposed by bridges, power lines, trees and other obstacles.

In addition, over the long history of building construction has evolved distinct architectural, safety and non discriminatory building paradigms. In the more populated areas and therefore major market areas, the market has demanded and even empowered local governments to create building ordinances to ensure some or all of these paradigms are adhered to. The more basic ones include, for example, high pitched roofs in residential areas, high ceilings in all construction, fire resistive construction and minimum requirements for egress and handicap access in commercial construction. And in recent years, local planning ordinances require minimum percentages of masonry on the exterior facade. These paradigms, desirable or mandatory, again pose challenges to the modular production process. Shipping height restrictions limit the height of roofs and the use of high or cathedral ceilings. Fire resistive materials tend to increase weight. In the past, in order to minimize weight, modular buildings have been built of wood products. However, because wood is combustible, building codes restrict the size of wood buildings and require fire rating and sprinkler systems when the floor area reaches a certain size. Wood is subject to termites and rot and is a relatively weak material whose strength diminishes when it gets wet. In areas where basements are generally not used, the lowest portion of the typical wood framed floor structure is required to be set a minimum of a half of a meter above grade so that moisture cannot cause it to deteriorate so quickly. This necessitates skirting the exterior walls to the ground, steps at all doors and a handicap ramp at least at one main door. These are large expenses if constructed of the more accepted poured on site concrete with steel handrails and relatively expensive and unappealing if constructed of the typical pressure treated wood. And finally masonry materials are very heavy and almost all but thin veneers such as stucco are almost impossible to attach to the building for shipping.

Also, as with any other manufactured product there are shipping, handling and installation costs. Although it is true materials have to be shipped to the conventional site, there is a well established infrastructure and materials have to delivered to the modular plant, as well. Shipping the modules is above and beyond this. And of course, the cost is proportional to size, weight, distance and quantity. The largest modules require escorts in addition to the equipment to pull it. Heavier modules require larger or stronger equipment to pull and handle them. Trucking company's charge by the mile and of course this is multiplied by the number of modules there are. Installation cost is a function of the number of modules. And material has to be applied to protect the modules from the elements until they are installed.

Further, shipping and handling a module can require applying forces on it in different locations or in larger magnitudes than would be experienced in the installed position on the foundation. Therefore, packaging not only includes protecting the product from the elements, but providing the appropriate structure or mechanism to withstand the stresses, deflections, vibrations and impacts induced by handling and the dynamics of traveling down the road. None of which may be experienced in conventional construction. These loads have been supported in an array of ways by the addition of columns, beams and braces in some manner or another. Since bending resistance is proportional to the cross sectional height of a member to the third power, the taller the beam the less it has to weigh and the more economical it will be. As height is one of a modules most valuable commodities, the tendency is to compress structural member height as much as possible. This has made it a challenge to incorporate strong efficient economical modules and packaging structures. The inverse of the beam strength characteristic is; to maintain strength, for very small reductions in height you have to add a lot of weight. As a result, short heavy inefficient members have been used. Resolving this issue would contribute the majority of the solutions to most of the other challenges as well. This requires a design that makes height restricted beams their most efficient. The solution lies in distributing as much of the cross sectional area that makes up the beam to the very top or bottom of the beam height limitations, as possible, and using the most suitable material in those top and bottom flanges.

In summary, all of these challenges contribute significant costs to a modular building that a conventionally built building would not have. But, they cannot be completely eliminated because a modular building has to be shipped. However, a properly designed system and production process should generate economic benefits that far outweigh the costs of shipping and installation, while providing the quality demanded by architectural paradigms. Only when costs and quality meet or exceed that of conventional construction can market share increase. This can only be accomplished by designing the most efficient structure and utilizing or exploiting some of conventional construction's inherent characteristics or weaknesses as well. This requires; shipping the largest module that can travel through the restriction envelope, providing a product that; is more appealing and acceptable to the market and local planning commissions, is more durable, is safer and minimizes additional on site work, minimizing weight, reducing structural redundancies for shipping, providing multistory modules to capitalize on the inefficiency of conventional construction on upper stories and utilizing conventional finishes where it is the optimal process.

I have worked in the modular building industry since 1987. And although the industry employs architects and professional engineers, the challenges listed above have continued to deter the industry from providing an economical system that can compete with the cost and quality of site built construction. Much headway wasn't made until 1996 when I developed and built an economical modular reinforced concrete floor for a previous employer. However, there didn't appear to be enough support in implementing the new product before it became common knowledge. Rather than continue with them, in 1997 I resigned and began working on a new design. Unlike the previous design, the present invention not only concentrates on an economical floor, but is lighter, stronger, can be used in multistory applications and emphasizes transportability and ease of handling as well. By incorporating the concept of a composite "T" beam which can be attached to other structural elements to create a compound and composite floor structure, optimal efficiency can be achieved. The final assembly being much stronger than the sum of the strength of the parts.

In reviewing the prior art, I believe the concept of applying composite "T" beam designs to modular building floor structures to be new. In the past, in the market, when concrete floors were required, with few exceptions, the strength was accomplished by utilizing large heavy steel members alone without incorporating the concrete floor into a composite beam or the concrete floor and other elements together as a compound composite beam. These heavy beamed systems are expensive and unable to compete with site built construction. In addition, the concept of creating a compound composite "T" beam by attaching the floor to a lighter carrier or first story ceiling frame, to my knowledge, has never been considered.

Several precast concrete manufacturers produce prestressed double "T" panels for conventional construction. However, these panels are extremely heavy and not suitable for modular buildings or attachment to a carrier for transporting the floor and the remainder of the building module's components such as walls, ceilings, roofs and subsystems etc. from the plant to the job site.

Design calculations for the present invention were based on engineering theory assimilated basically from the inventor's engineering education and from Hick's, Standard Handbook of Engineering Calculations, published in 1972 by McGraw Hill. This reference discusses theory and calculations for several design methods for compound, composite and "T" beams separately, but does not specifically discuss or provide a design method for the subject invention or any other modular concrete floor.

Previous patents have made attempts to resolve some of the challenges of modular construction, but very few provide the comprehensive solution the present invention does. A lot of them are penalized wall systems. Others are variations of existing structurally inefficient modules or some part thereof Some take a residential perspective and others a commercial, but any found to address one or more of the challenges listed above are discussed here. To start, U.S. Pat. No. 5,765,316 to Kavarsky (1998) attempts to solve the shipping height and pitched roofs problem with a telescoping members and a hinged roof This requires some relatively expensive column and hinging devices and then a lot of finishing on site.

The following patents attempt to address fire resistance, strength and durability with versions of steel and/or concrete modules. These are typically single story only, structurally inefficient and/or heavy and therefore not cost competitive, but worthy of mention because they typify the general nature of the modular industry. U.S. Pat. No. 4,882,883 to Horn (1989) is closest to the typical lightweight steel framed module built today. The floor is a welded steel main frame and joist with an expensive metal deck welded on top which is then covered with a wood floor deck. The floor structure tends to deflect during transportation if additional bracing is not installed and may cause the floors to have high and low spots. In addition, the floor system sounds hollow when you walked on it giving it the impression of a mobile home. And typically, if the customer accepted the mobile home feel there were plenty of wood framed modular systems that were more economical than this structure. Further, it is believed these are still set off the ground like a mobile home which required the use of skirting and steps and ramps at the entrances. U.S. Pat. No. 4,833,841 to Ellington (1989) has a steel mainframe that supports a concrete floor in a metal composite deck. The author of the present invention actually went to work for this company in 1987 and 1988 after it was developed. At the time this appeared to be a good system. However, in the last few years the author has strengthened his structural knowledge and now sees the deficiencies of this system as well. The floor slab was very heavy and inefficient which did not allow the modules to maximize the allowable shipping volume. U.S. Pat. No. 5,113,625 to Davis (1992) shows a floor that requires a "pan" on top and between main beams and steel joists to support insulation. A relatively expensive corrugated metal deck is required to be welded on top of the steel framing and then concrete is poured in which is reinforced with some unidentified reinforcement. But then in contrary to the reinforcement and a desire to "withstand high stress loads" joints are formed into the concrete with "splitters" to prevent cracking. U. S. Pat. No. 5,044,134 to Brockway (1991)is a steel structure. The floor and walls are framed and sheathed with steel and the module is then shown to be placed on a slab poured on site.

This has redundant floor structures and probably would not be an energy efficient structure for residential or commercial use. U.S. Pat. No. 4,910,932 to Honigman (1990) is actually concrete and steel wall and floor panalized system, where the panels are produced in a plant, trucked in a flat stacked manner and then assembled on site. But as with the "splitters" above, a lot of joints in a structure do not tend to induce strength and structural or energy efficiency, not to mention aesthetics.

Several patents attempt to address durability and fire resistance in different versions of multistory modules. This is a step in the right direction because manufacturing a module on the ground and then setting it in place should be safer, faster and more efficient than having to maneuver labor, equipment and materials up and down 2 or more stories in a conventional manner. These come in two varieties; completely concrete or steel frame and concrete.

In the completely concrete group, U.S. Pat. No. 4,930,273 to Papesch (1990) actually appears to only address a stair system and ingress egress flow for a multistory modular concrete building. U.S. Pat. No. 4,525,975 to McWethy (1985) illustrates a multistory modular building where the concrete modules, each with four walls and a floor, are set apart from each other slightly. The cavity created between the outside walls of two adjacent modules is reinforced and more concrete is poured in between. These are very heavy and cannot be built in large pieces. U.S. Pat. No. 3,952,465 to Masiello (1976), 5,233,808 to Salmenmaki et al. (1993) and 3,992,848 to Stucky (1976) again are modules with relatively thick, heavy concrete floors and walls, but do not require pouring additional concrete for the structure. These patents typically don't detail how utilities are installed or how the walls are insulated and may require additional material and labor to provide chases for these items.

In the, lighter, steel frame and concrete floor group; U.S. Pat. No. 4,513,545 to Hopkins, Jr. (1985) is a multistory framed modular system that requires a slab be poured on site for the first floor and then uses a framed floor for subsequent stories. U.S. Pat. No. 4,807,407 to Horn (1989) is a steel framed module that describes a system for lifting it with a crane and has the floor system shown in U.S. Pat. No. 4,882,883 to Horn (1989). This illustrates some of the redundant members that have been used to aid in shipping and handling. The author is not sure if U.S. Pat. No. 4,077,170 to van der Lely (1978) is meant to be a multistory system or not, but placed it here because it is the next step in a series of better designs than have been discussed so far. It has a clever floor structure where the steel frame has welded to its top flanges a grid of reinforcing bars. The floor structure is turned over and immersed into an approx. 5 cm thick bed of concrete, allowed to harden and then flipped back over. This appears to be the most efficient structure thus far, however, with a few corrections it could be much better. To start, the slab and the main frame beams may separate and or be subject to sliding relative to each other under load. Another element may need to be added to prevent this and make the system much stronger. Also, it appears that the slab could develop cracks above the beams that support it due to a lack of reinforcement against the negative moments that would develop, especially over a member like intermediate beam 7 in FIG. 15. This would render the slab in effect a series of simple beams that would be subject to larger stresses and deflections than a multispan configuration would. In addition, members 141 are not in the optimal location. And finally, having to flip the steel frame and then the steel and concrete floor may be a capital intensive process. U.S. Pat. No. 4,545,159 to Rizk (1985) has many features that make it the best, in the authors opinion, of the prior art. It has an approx. 5 cm thick slab also, but it improves on some of the deficiencies of the previous patent. First it utilizes shear connectors to tie the slab to the main frame. This helps to make a much stronger member. Second, it ties the intermediate framing into the slab as well. Third, it shows a wire mesh that is not required to be welded to the steel frame for reinforcing as opposed to the more labor intensive individual reinforcing bars. Some of the criticisms, though, would include, again a possible lack of negative reinforcement. The use of a bar joist for the main frame is a good idea in upper stories, but causes the first floor to sit above grade, necessitating skirting, steps and ramps. Also the bar joist is shown in a simply supported situation and there is redundant framing in the ceiling not connected to the light bar joist above. This is not the most efficient framing system and even though the bar joist is tied into the slab, the spanning capabilities of this structure appears to be minimal. Also, as with the previous patent, the main frame members are placed on the perimeter of the concrete slab creating an upside down double "L" shaped beam. The standards regulating the concrete and steel industries don't allow the strength that a "T" beam can provide if the top flange does not overhang either side of the web a minimum amount. In addition, the main frames on the perimeter cause the transverse purlins to act as simply supported members. This is not the most efficient beam configuration. Further, the exterior finish appears to be complicated and industrial looking. This is not appealing today with the popularity of modern neoclassical architecture. And finally, as with the previous inventions, transportation and handling is not detailed and could be difficult.

U.S. Pat. Nos. 4,065,892 and 4,067,158 both to Lawrence (1978) attempt to address transportation by utilizing a reusable axle and hitch assembly. As shown in U.S. Pat. No. 4,114,328 also to Lawrence (1978) from the perspective of a wood framed module requires that it be rigid enough to span the distance from the hitch to the set of axles. This is an efficient transportation system if this is the case. However, there are many building situations where there are no or too few walls or the correct structure to provide the necessary rigidity. And the typical wood framed floor structure could not span this distance without them. In this case, additional temporary bracing is required and if steel beams are still required below the wood framing than this is less efficient than just using the steel beams alone.

The aforementioned patents attempt to solve some of the challenges associated with modular construction. Some maybe good ideas and others not so good, but none of them provide an all encompassing optimum solution. The present invention provides a building system with a more comprehensive more efficient solution than has been provided in the prior art.

Objects and Advantages

Several objects and advantages of the present invention are:

(a) to provide a multistory modular compound composite concrete and steel floor that can be produced for about the same cost that standard modular wood floors are produced today;

(b) to provide a multistory modular compound composite concrete and steel floor that can be as easily and economically transported, installed and relocated as modular wood floors;

(c) to provide a multistory modular compound composite concrete and steel floor that can be produced more economically than existing modular concrete floors;

(d) to provide a multistory modular compound composite concrete and steel floor that can be more economically transported, installed and relocated than existing modular concrete floors;

(e) to provide a multistory modular compound composite concrete and steel floor building system that can compete with, if not outperform, conventional construction in cost, quality and aesthetics.

Still further objects and advantages will become apparent from consideration of the ensuing drawings and description.

DRAWING FIGURES

A more complete representation of the invention and advantages thereof will be readily appreciated when the description is read with reference to the accompanying drawings in which.

SUMMARY

In accordance with the present invention, a modular compound composite concrete and steel floor (or floor/ceiling assembly) comprises an upper concrete planar flange, a lower metal flange, a means for holding separate and permanently or temporarily connecting the upper concrete planar flange to the lower metal flange or a lower yet additional metal flange, a hitch assembly and a wheel assembly for transporting and relocating the same.

DESCRIPTION AND OPERATION

Figure 1:
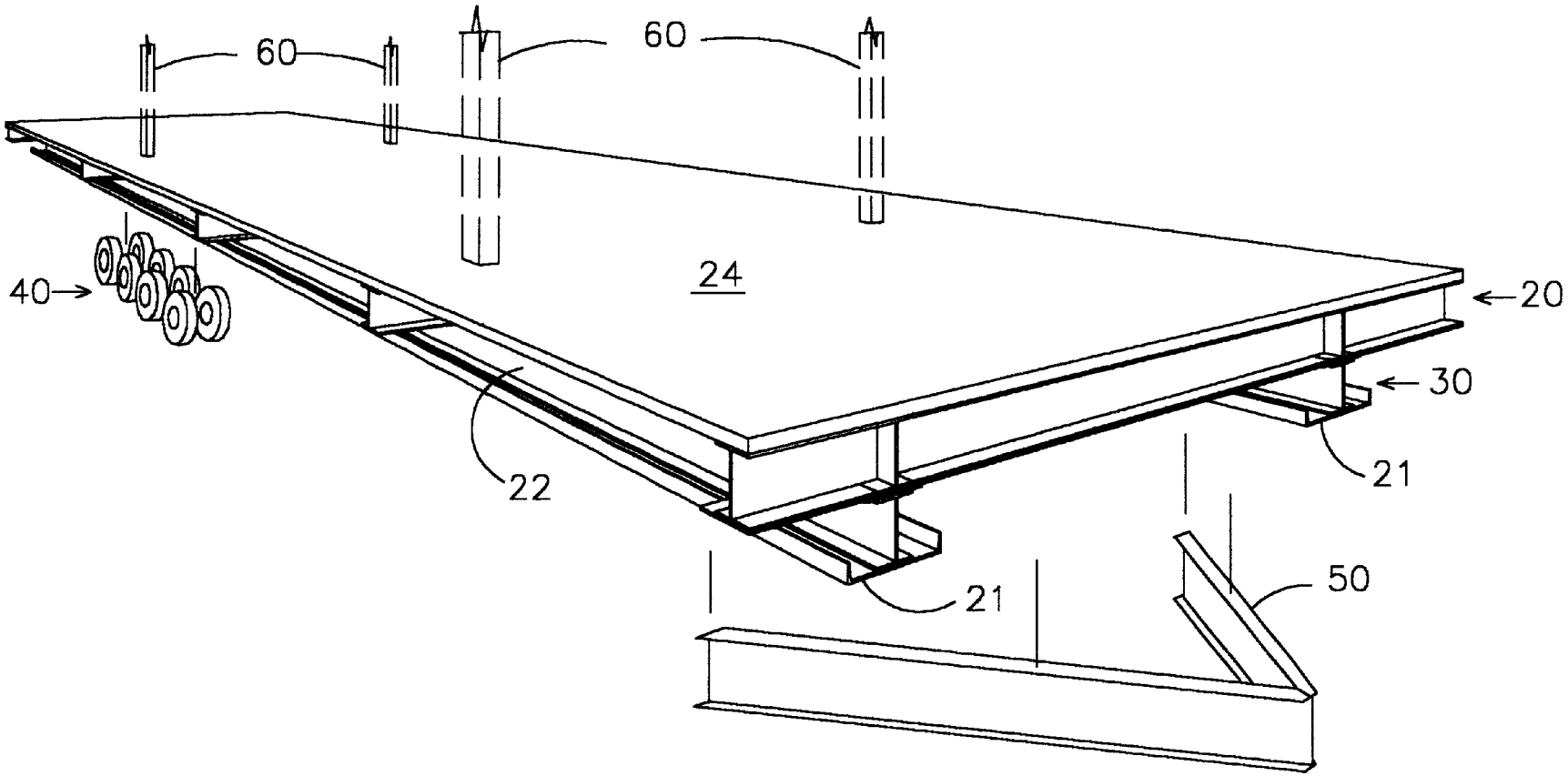
FIG. 1 shows a perspective of a composite floor attached to a carrier frame with the hitch and bogie system shown detached.
Figure 2:
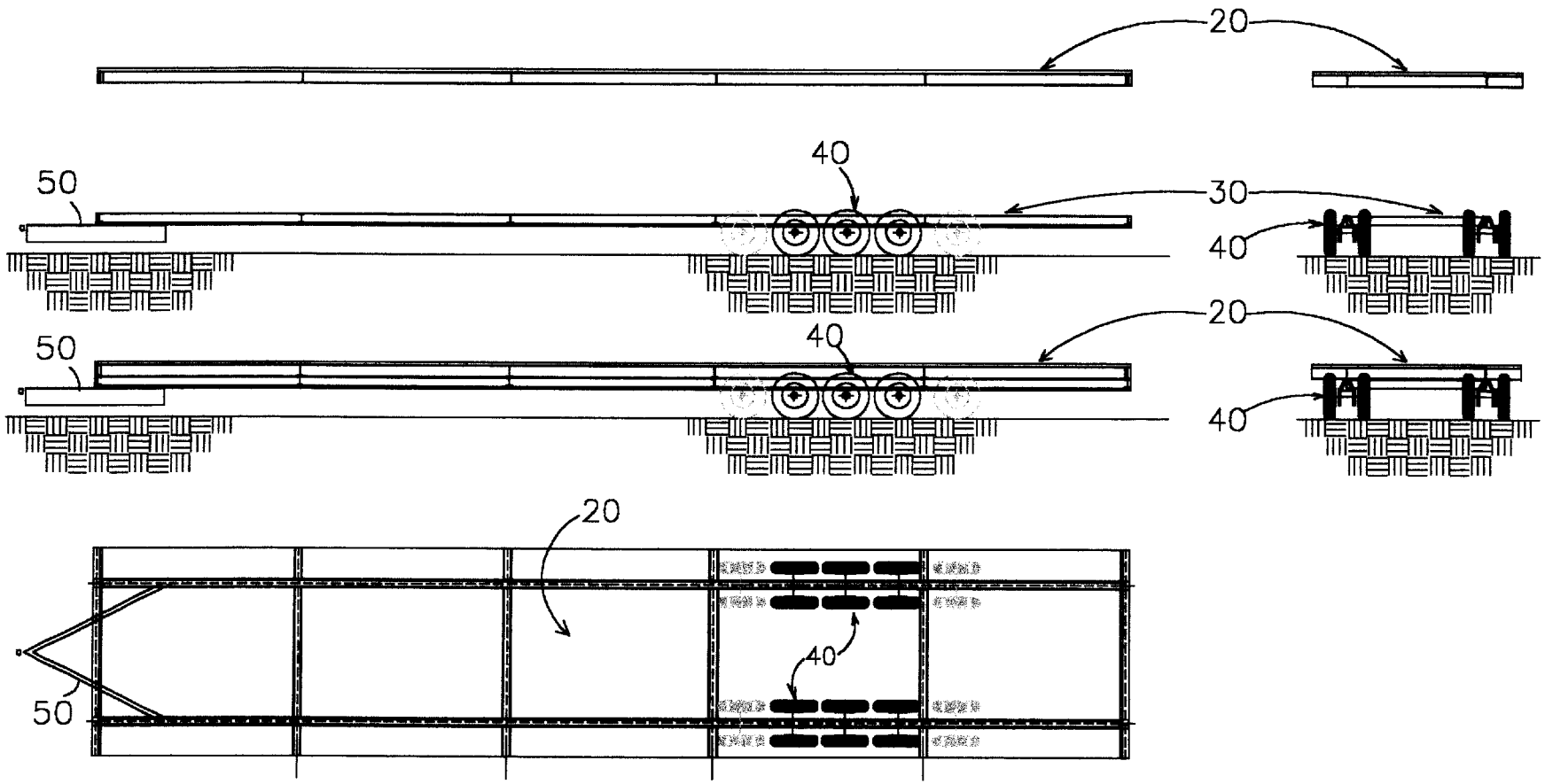
FIG. 2 shows the plan, longitudinal and transverse end view of a floor and carrier in attached and detached positions.
Figure 10:
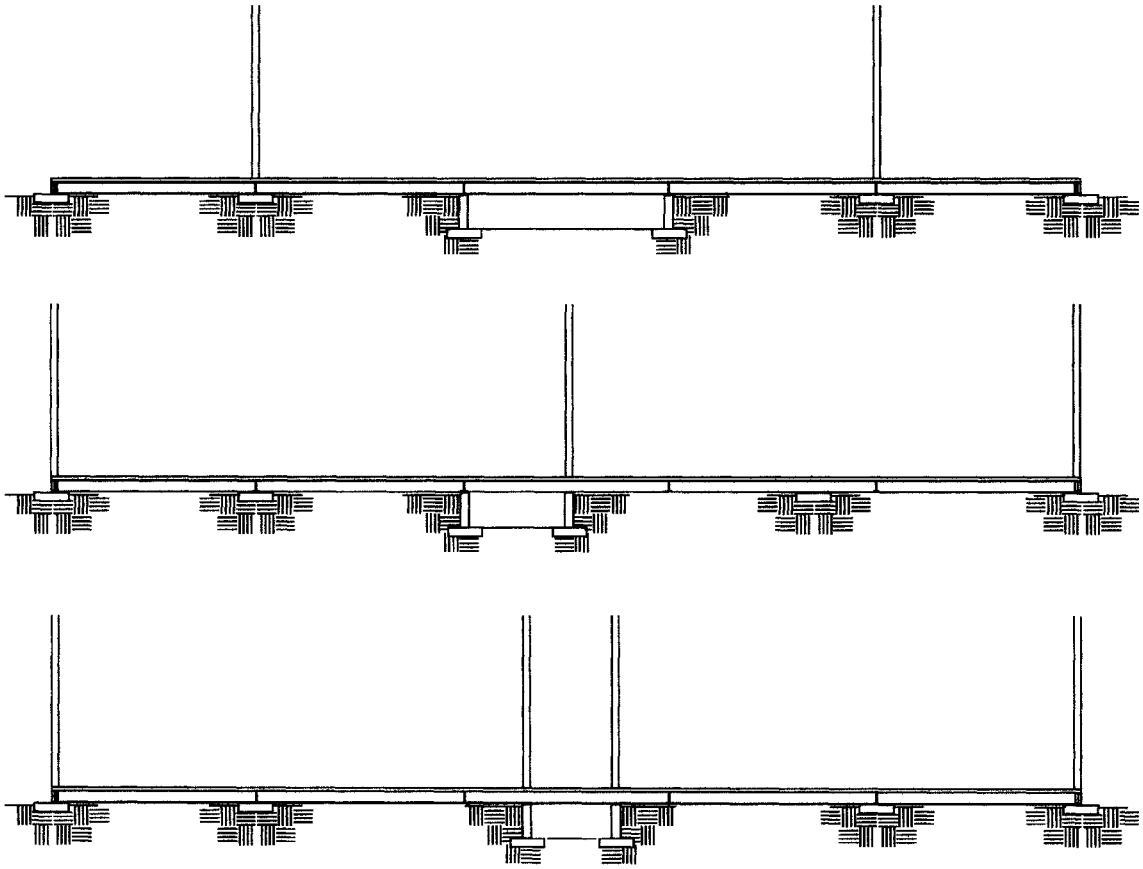
FIG. 10 shows a longitudinal view of some of the optional column locations on a floor.
Figure 11:
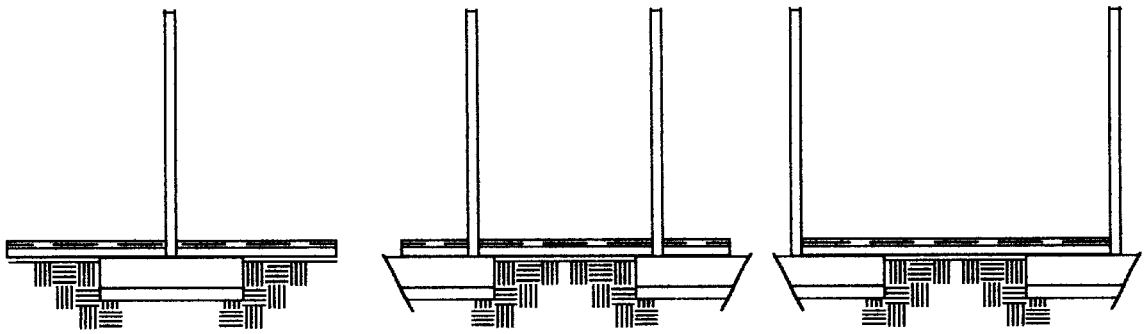
FIG. 11 shows an transverse view of some of the optional column locations on a floor.

FIG. 1 shows a partial perspective of the compound composite concrete floor and carrier system. The actual concrete floor and module dimension can be varied to fit almost any module or floor plan shape or size. It is composed of 4 basic parts; a composite concrete and steel floor 20, a carrier frame 30, a wheel, axle or bogie asembly item 40 and a hitch assembly 50. FIG. 2 shows the plan, longitudinal and rear transverse views without columns. FIG. shows a standard hitch 50 and an optional 5th wheel hitch 50A. On at least the first floor module in multistory applications there would also be column structures 60 as shown in FIGS. 1, 10 & 11.

Figure 4:
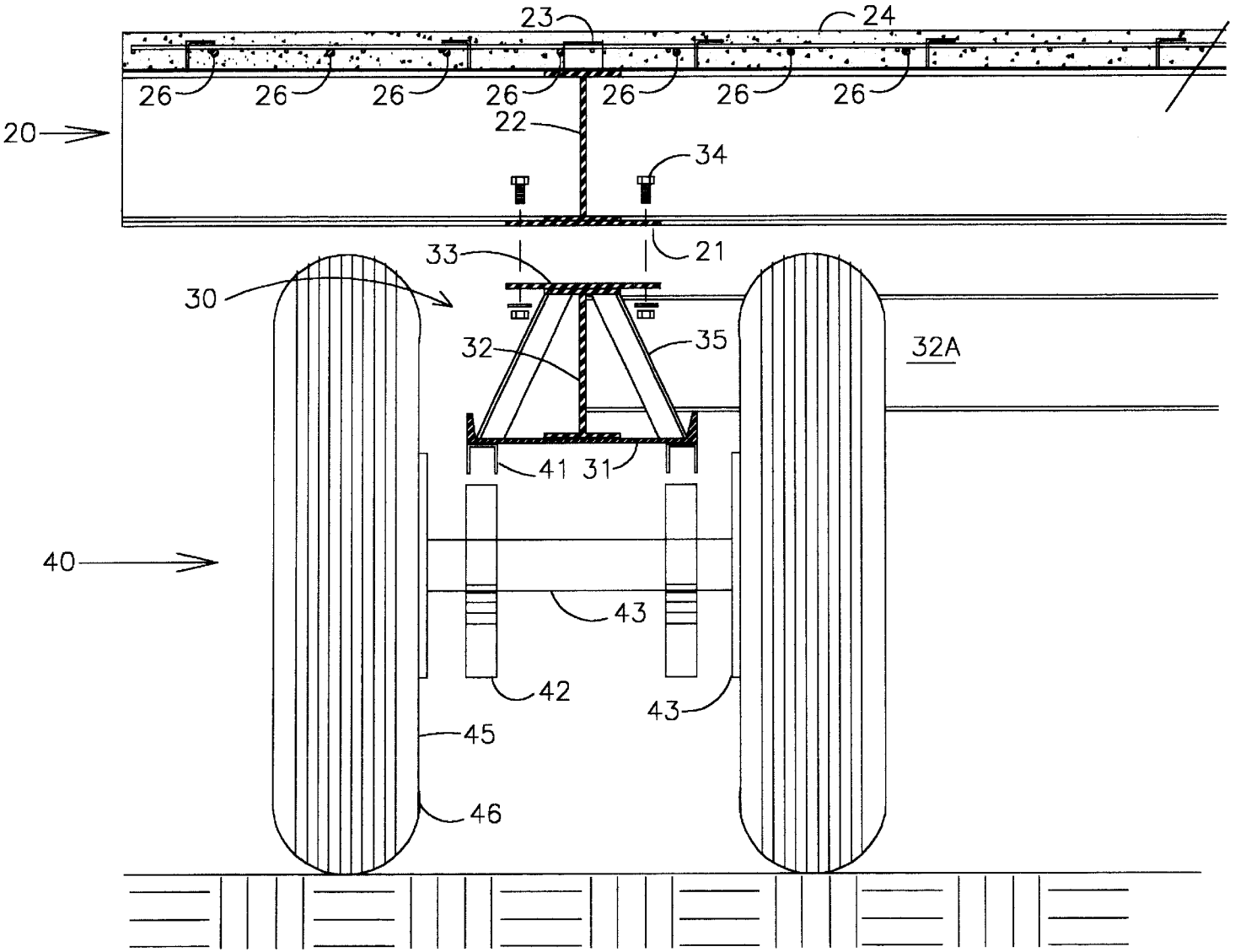
FIG. 4 shows an enlarged partial transverse section of the floor, carrier and bogie axle assembly.
Figure 5B:
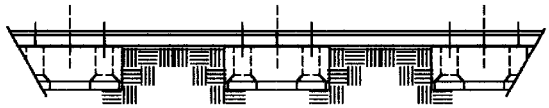
FIG. 5, 5A & 5B illustrate longitudinal and transverse end views of the floor on two sample foundations.
Figure 5A:
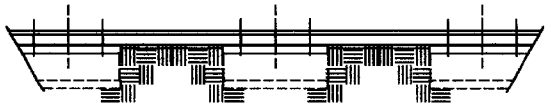
Figure 5:
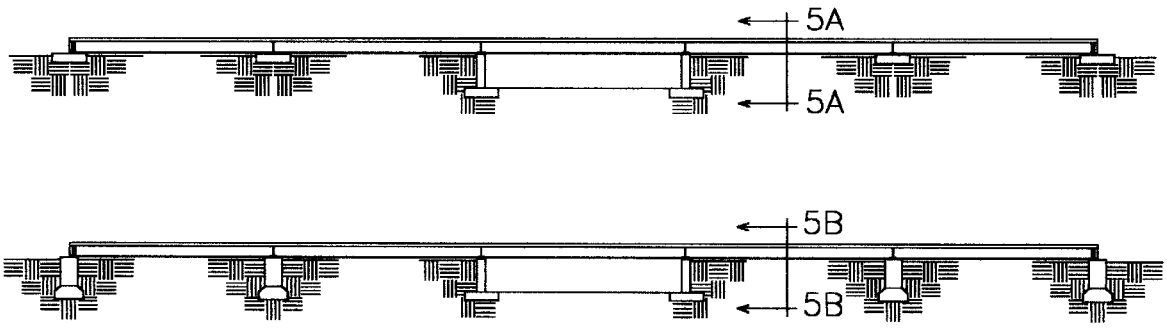
Figure 6:
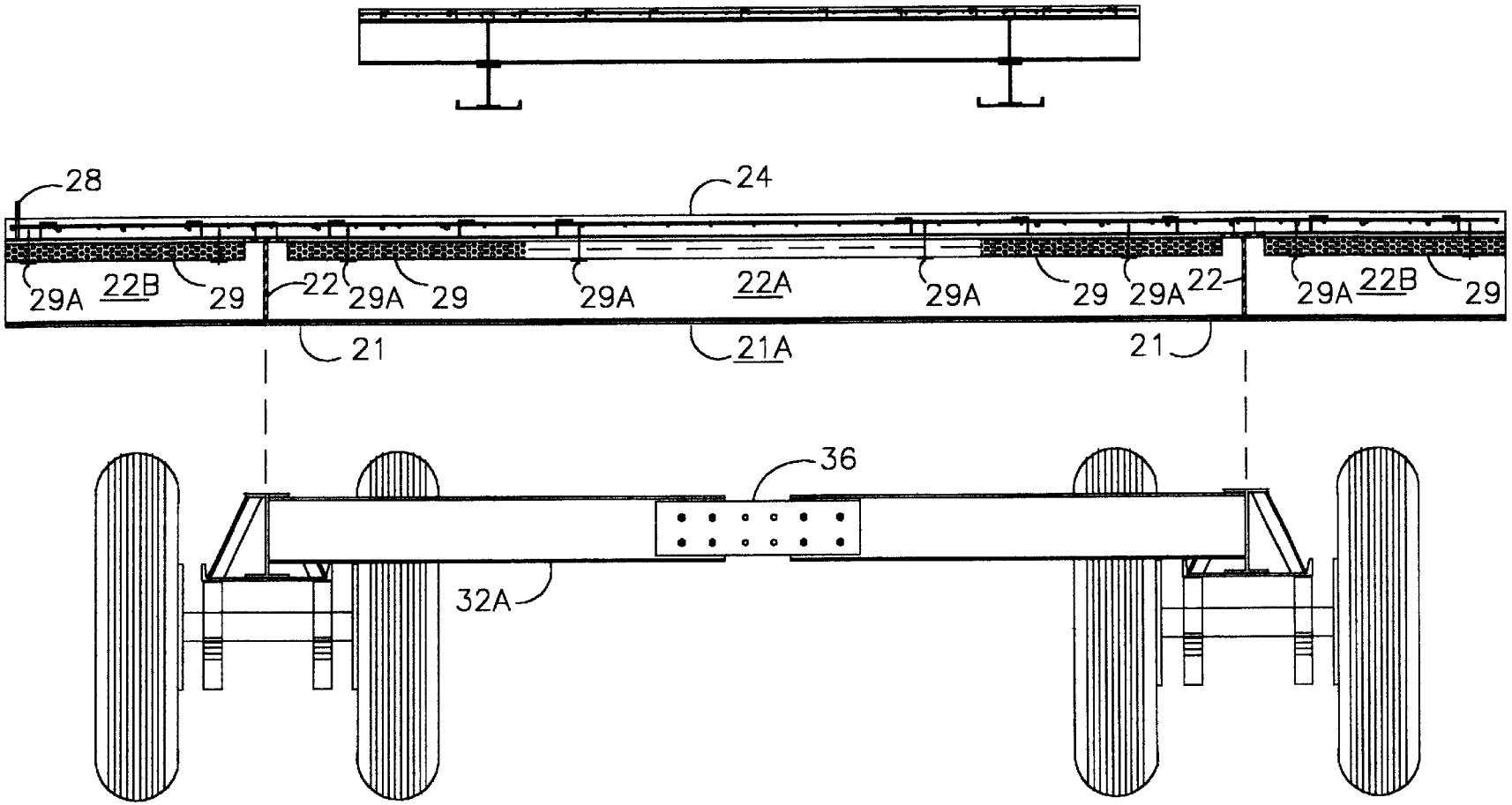
FIG. 6 illustrates the compound double "T" created by the connection of the floor to the carrier.

FIG. 4 shows a section of the composite concrete and steel floor and carrier system. The floor consists of a floor metal flange or floor tension chord 21 (steel bar, plate or equivalent the length of the floor) which is welded to the bottom of a floor web member 22 (any structural shape). The spanning capabilities of this structure can be adjusted by varying the cross sectional area of the web tension chord and/or the height of the web member 22. The web member has welded on top of it's top flange a plurality of shear connectors item 23 ( short pieces of steel angle, channel, welded studs or anchors) to connect it to and provide shear resistance with an approximately 5 cm thick lightweight high strength concrete slab 24. This system effectively connects the tension chord 21 to the concrete slab 24 which creates a very strong composite "T" beam. This structure possesses a relatively high moment of inertia when the moments are such that the slab 24, upper flange, is in flexural compression and the tension chord 21, lower flange, is in flexural tension. Longitudinal reinforcement 26 (a plurality of steel reinforcing rebar) is placed in the concrete slab to help resist negative moments above the axles when the floor system is being transported as shown in FIG. 2 and above foundation footings, grade beams or piers on the ground as shown in FIG. 5. As there will always be at least a pair of these tension chord 21-web member 22 arrangements per module to provide stability as shown in FIG. 6, this configuration could be regarded as a double "T". Items 21 and 22 are generally set in from the outside edge of the slab 24 for two purposes; one, to provide symmetry so the floor acts as and receives all the structural benefits of a "T" beam in the longitudinal direction and two, to minimize induced internal slab loads, stresses and deflection in the transverse direction. This is accomplished because as the web members 22 are moved from the outer edge of the floor toward it's center, the absolute value of the moment above them increases as the moment at the mid span between the web members decreases. The actual dimension of the overhang can vary to provide the optimum location for each specific case, but will be in the magnitude of ⅓ to 1 meter.

Figure 7:
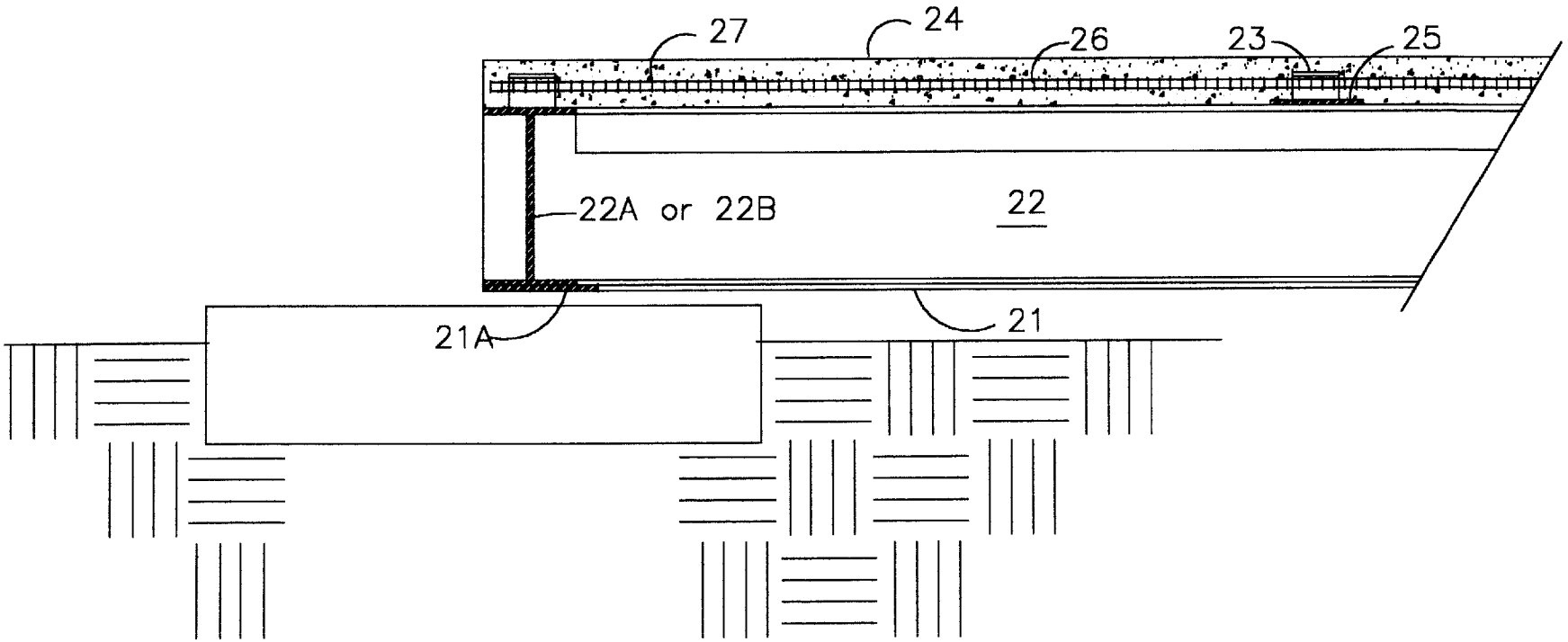
FIG. 7 shows an enlarged partial longitudinal section of the floor on a footing.

Continuing with the floor, FIG. 7 shows the web members 22 also have welded to their top sides, a plurality of slab tension chords 25. The slab tension chords 25 (steel bar or plate approx. ⅓ to 1⅓ meter on center) are perpendicular to the web members 22 and lie across the entire width of the composite concrete floor. If necessary, these could be galvanized, painted or coated to resist corrosion. These also have welded to their top sides a plurality of shear connectors item 23 to tie them into the concrete slab 24. These act to create a series of adjacent smaller transverse composite "T" beams for the length of the floor. For negative moment reinforcement above the web members 22, positive moment reinforcement between slab tension chords 25 and to help resist cracking in the concrete slab 24 in general, welded wire mesh item 27 is placed in the concrete throughout the entire slab area.

Figure 8:
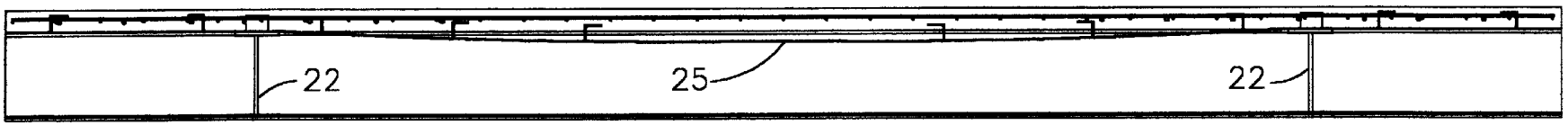
FIG. 8 shows a transverse section of the floor with a catenary rib.

For heavier load capacity, the floor slab can be strengthened by allowing the slab tension chords item 25 to drape down in an approx. catenary curve between the web members 22 to create ribs on the bottom side of the concrete slab item 24 as shown in FIG. 8. This provides a deeper "T" beam stem where the maximum bending moment should occur. Optionally, heavier load capacity can be obtained by placing the slab tension chords item 25 down in the bottom of ribs that are the same depth across the entire width of the module. In this case the web members item 22 and the web cross members item 22A would be reduced in height an amount equal to the depth of the ribs or the top surface of the floor would be raised an amount equal to the depth of the ribs. The height of the shear connectors item 23 could be appropriately changed, if necessary.

Continuing with the composite floor, FIG. 6 shows web cross members 22A which are placed at each end of the floor and evenly spaced approximately 2½ to 7 meters on center along it's length. These have extensions 22B that go to the outer edge of the floor width that can be used to help support wall loads and act as handling, lifting or jacking points. The web cross members and extensions also have welded to their bottom flange, cross member tension chords 21 A for reinforcement while lifting or supporting the module at minimal isolated points. This also ensures the bottom surface of the floor frame is uniform so that footing, grade beam or pier locations can remain flexible. Anchor bolts or studs 28 can be welded to the tops of the slab tension chords 25, web members 22 and web cross members 22A where they intersect walls to provide uplift and shear resistance. The floor can be insulated 29, with polystyrene, urethane, isocyanurate or any other rigid sheathing. The insulation can be attached by inserting fasteners item 29A through the insulation that would protrude into the slab an appropriate amount. The insulation would be set in the forms with the fasteners in place and the concrete poured on top encapsulating them.

FIG. 4 also shows a section of a composite floor carrier frame 30. It is comprised of a carrier metal flange or carrier tension chord 31 (channel, bar, plate or equivalent with the web laid in the horizontal plane the length of the carrier and the floor) which is welded to the bottom flange of a carrier web member item 32 (any structural shape). The carrier web members 32 are located so their centerlines are approx. in line with the centerlines of the web members 22 of the composite floor. The top of the carrier web member 32 may have welded to it carrier shear connector plates 33. These could comprise small square steel plates that are evenly distributed down the length of the carrier web member 32 and used to temporarily connect the composite floor carrier frame to the bottom of the composite concrete floor. The shear resistance is mainly provided by a nut and bolt assembly item 34 and/or temporary welds that could be cut when the floor is to be removed. Optionally or in addition to this, the mating faces of the shear connector plates 33 could be grooved, knurled or otherwise roughened to increase the shear capacity and then a quick disconnect or clamping device could be used to ensure the shear connection. Similarly as before, this effectively connects the carrier tension chord item 31 to the concrete slab 24 to create a taller stronger compound composite "T" beam that can easily withstand the static and dynamic stresses induced by supporting the entire module only at the wheels and hitch during module completion at the manufacturing facility and/or shipment to the building site. FIG. 6 illustrates this taller stronger double "T".

For lateral stability of the carrier web members 32 the compound composite floor carrier frame also has carrier frame cross members item 32A (any structural shape, angle iron, etc.) as shown in FIG. 4. These, however, only span the distance between the carrier web members 32 and no web tension chord is required to be welded to their bottom flange. These could be made adjustable to fit any floor web member 22 location by adding a connector plate 36 or a telescoping mechanism in their length as shown in FIG. 6. The hitches would have additional bolt holes to allow the adjustment of the carrier width as well. Spring mounting brackets item 41 in FIG. 4 are welded to the bottom of the carrier tension chord 31. At each spring mounting bracket location and as necessary down the carrier length, a carrier tension chord brace item 35 (steel angle, plate or equivalent) is attached to provide stability. This helps to transfer uneven tire loads to the center of the "T" beam and keeps the tension chord in the horizontal plane for maximum strength. The composite floor carrier frame is built to match the length of the module.

Figure 9:
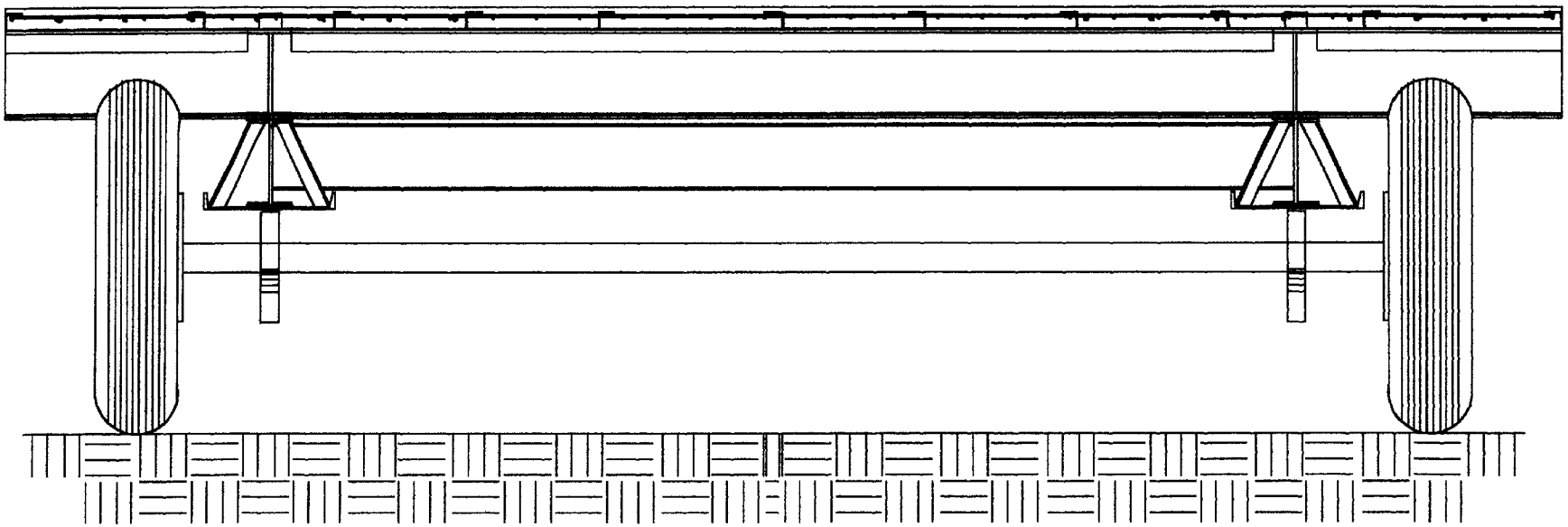
FIG. 9 shows the floor and carrier on a standard axle assembly.

FIG. 4 shows a bogie axle assembly 40. These comprise spring brackets 41, springs 42, axles 43, brake or idler hubs 44, wheels or rims 45 and tires 46. These are used when module weight requires a heavier carrying capacity. Incremental adjustments in carrying capacity can be made by varying the number of bogies. They can be made by cutting to length and welding back together standard modular and mobile home axle assemblies and are readily available on a custom basis in the market. When module weight allows, a standard modular building or mobile home axle assembly can be used as shown in FIG. 9. As before, the carrying capacity can be adjusted by varying the number of axles.

Figure 12:
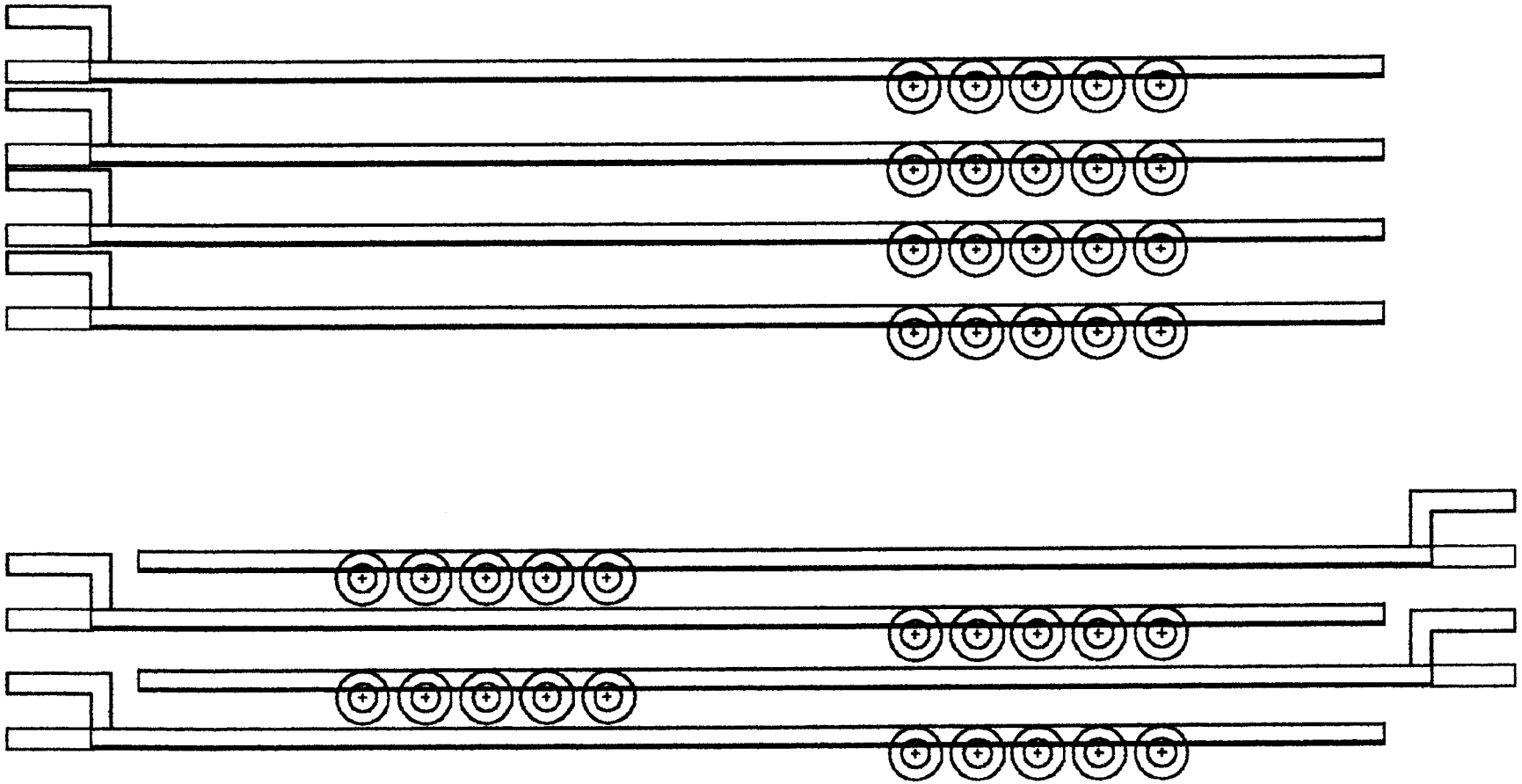
FIG. 12 shows optional stacking patterns for return of the carriers to the manufacturing facility.

After the composite concrete floor 20 has been poured and allowed to cure and achieve the appropriate amount of strength, it can be placed on and connected to the carrier frame 30, with or without axle and wheel assemblies 40 or hitches 50 or 50A, for the remainder of the module production. The floor can be used with load bearing or non load bearing walls. In the latter case columns 60 to support a a roof structure or upper story floors can be welded into column receptacles or directly into the floor system at various locations, as shown in FIGS. 1, 10 & 11. The column cross sections could vary from the top floor to the first, to support the loads appropriately. Completing the module would include installing wall and ceiling and/or roof framing, insulation, utilities and some or all of the finishes. After the module/floor 20 is removed from the carrier at it's final location, the carrier frame 30 is returned to the manufacturing facility to be reused for an indefinite number of times. To minimize return shipment costs, several carriers could be stacked as shown in FIG. 12.

Upper floors of a multistory module/building would use the same composite concrete and steel floor system 20.

FIG. 5 illustrates several foundation configurations. Utility mains can be run in, and accessed for maintenance via, the partial crawl space excavated below the first floor. One of the important characteristics of the floor is the finished floor height. The present invention can have finished floors elevations set at 20 to 30 cm above grade. This is a fraction of typical modular installations heights and approaches that of conventional slabs on grade.

SUMMARY, RAMIFICATIONS, AND SCOPE

Once the strength and ease of use of the present invention is appreciated, building applications and configurations become greatly expanded over the presently available modular systems. In summary, this invention is a higher quality more economical building system. It can be used to create high appealing spaces. It is fire resistive and sets low on the ground for easy egress and ingress. It is durable and will not deteriorate if it gets wet. It is a very strong structure that maximizes the available shipping envelope while remaining relatively light. It can be transported with a minimum amount of bracing. And transportation and installation costs are about the same if not less than a typical wood framed modular building. This system clearly addresses the challenges of modular construction with a comprehensive efficient system that should provide more value than either existing modular or conventional construction.

Figure 3:
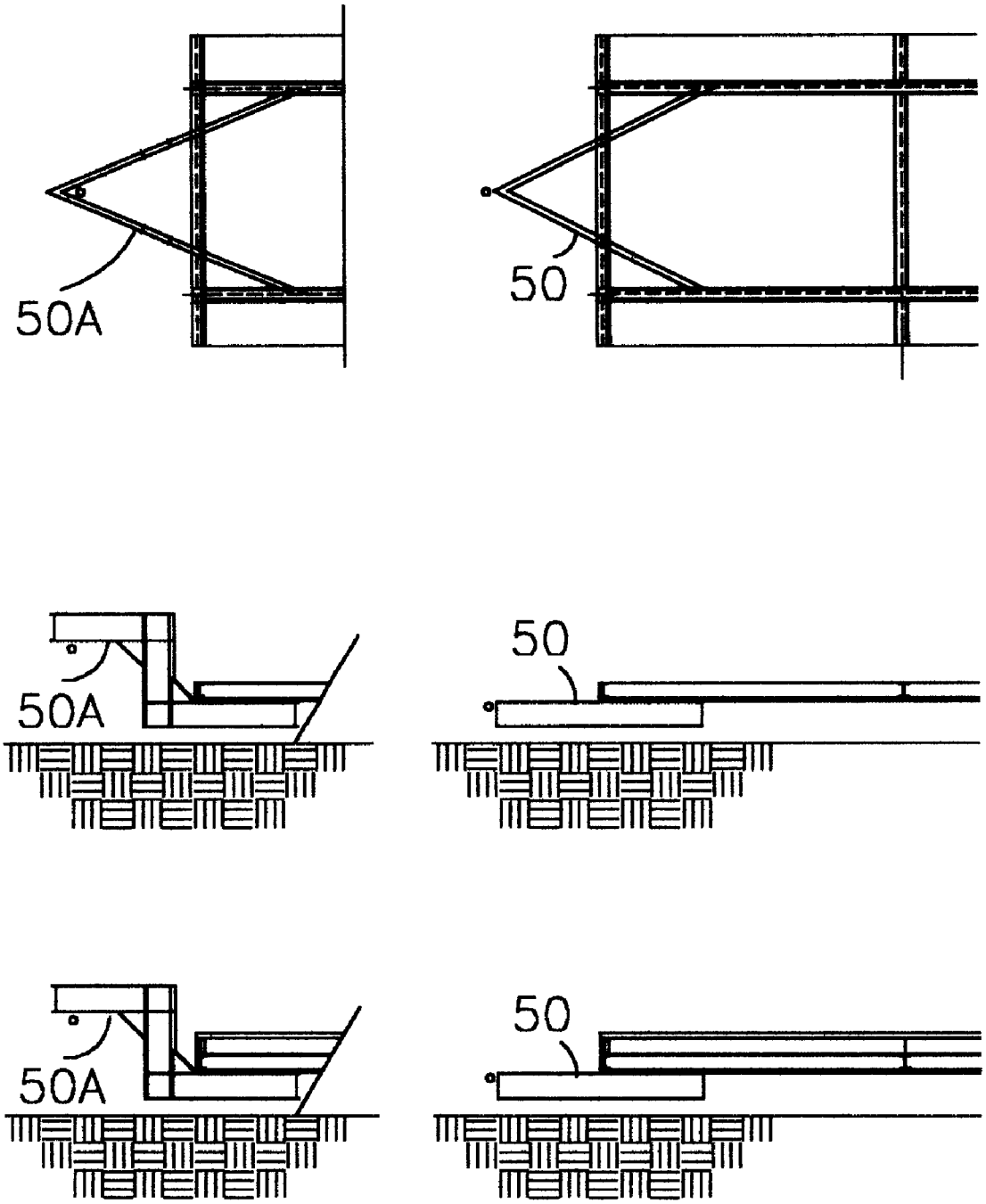
FIG. 3 shows optional hitch assemblies.

Although the description above contains many specifications, these should not be construed as limiting the scope of the invention but merely providing illustrations of some of the presently preferred embodiments of this invention. Any of the members could be replaced with any custom made or commercially available structural shapes, truss or combination of such. It maybe possible to replace steel rebar and/or welded wire mesh with glass fibers and/or fiberglas rebar. The light weight concrete maybe replaced with cellular concrete, normal weight concrete, any material that possesses similar strength or any combination thereof The carrier 30 could be built in a shorter standard size and then lengths added to obtain full module length as long as the cross section of the carrier tension chord 31 is maintained throughout the length by bolted or welded connector plates. The front section would contain the hitch assembly item 50 or 50A as shown in FIG. 3. As an alternative, the carrier frame could be made telescopic again so long so long as the carrier tension chord 31 is continuous and maintains the cross sectional area down the entire length of the floor. There are available good quality manufactured bogies (although they appear to be relatively expensive at this time) that could replace the bogie axle assembly described.

I claim:

1. A compound composite concrete and steel floor and carrier assembly comprising:

(a) an upper concrete planar flange for supporting occupants, furniture, etc. of a building and acting as a compression member in bending, (b) a lower floor metal flange for acting as a tension or compression member in bending or a connector, (c) a floor web member for permanently holding and rigidly connecting, in spaced relationship, the lower floor metal flange to the bottom side of the upper concrete flange creating a composite "T" beam of said upper concrete flange and lower floor metal flange, (d) a second lower metal flange for acting as a tension or compression member in bending, (e) a second web member for holding and rigidly connecting, in spaced relationship, the second lower metal flange to the bottom of the lower floor metal flange creating a deeper compound "T" beam of said upper concrete flange and second lower metal flange, (f) a wheel assembly for allowing travel, (g) a hitch assembly for temporarily attaching a truck in order to transport said concrete floor and carrier.

2. The compound composite concrete and steel floor and carrier assembly of claim 1 wherein said concrete planar flange has attached to its bottom surface, by shear connectors, a plurality of transverse metal flanges acting as tension members for creating a series of adjacent small transverse composite joists of said upper concrete flange and transverse metal flanges.

* * * * *